United States Patent [19]

Tarassoli

[11] 3,967,736

[45] July 6, 1976

[54] BOOM CONTROL SYSTEM

[75] Inventor: Iradj Tarassoli, Trussville, Ala.

[73] Assignee: Bush Manufacturing Company, Trussville, Ala.

[22] Filed: Nov. 21, 1974

[21] Appl. No.: 525,927

[52] U.S. Cl. ..... 212/42; 212/61

[51] Int. Cl.[2] ..... B66C 3/00

[58] Field of Search ..... 91/420; 60/460, 464; 212/61, 62, 66, 68, 42, 44; 214/16.4 A

[56] References Cited

UNITED STATES PATENTS

| | | | |
|---|---|---|---|
| 2,657,533 | 11/1953 | Schanzlin et al. | 60/460 |
| 3,230,699 | 1/1966 | Hann et al. | 60/464 |
| 3,351,107 | 11/1967 | Hamilton | 214/147 G |
| 3,701,442 | 10/1972 | Dunning et al. | 214/16.4 A |
| 3,708,077 | 1/1973 | Richens et al. | 214/16.4 A |
| 3,871,714 | 3/1975 | Behrend | 254/150 FH |

OTHER PUBLICATIONS

"Bush Log Handling Boom," by Bush Mfg. Co., pp. 44, 45 of Forest Industries, Mar. 1973.

*Primary Examiner*—Robert J. Spar
*Assistant Examiner*—Lawrence J. Oresky
*Attorney, Agent, or Firm*—Newton, Hopkins & Ormsby

[57] ABSTRACT

A boom is disclosed comprising a pivotable structure including an upright support having wheels rotably supported on a rail and a truss supported above the rail by the upright support. A grapple is suspended from the truss and a winch mounted to the pivotable structure for raising and lowering the grapple. Hydraulic circuit means are mounted to the pivotable structure for driving the wheels, winch and grapple. Electric circuit means are also provided for controlling the hydraulic circuit means and which includes a set of solenoid valves mounted on the pivotable structure and a set of solenoid valve actuators mounted off the pivotable structure.

7 Claims, 6 Drawing Figures

BOOM CONTROL SYSTEM

BACKGROUND OF THE INVENTION

This invention relates generally to booms, and particularly to boom control systems.

In the March, 1973 issue of *Forest Industries* there is illustrated a log handling boom comprising a truss pivotably mounted at one end centrally of a circular rail with the other end overhanging the rail and supporting a grapple. The truss is supported above the rail itself by an upright A-frame structure having wheels rotably mounted at the bottom thereof atop the circular rail. The article proposes that the boom be controlled from a central control point located remotely from the boom. The present invention relates to such a remote control system for this type of log boom as well as for those of more conventional construction.

Accordingly, it is a general object of the present invention to provide a boom with a remote control system.

More specifically, it is an object of the present invention to provide a boom having remote control means for swinging the boom, for operating a grapple suspended therefrom, and for raising and lowering the grapple.

Another object of the invention is to provide a boom with means for controlling the swinging movement thereof without need for limit switches, valves or the like.

Another object of the invention is to provide a boom control system having means for limiting hydraulic pressure build-up occasioned by a coasting of the boom under its own momentum.

Yet another object of the invention is to provide a boom with improved means for braking one or more operative components thereof in the event of power failure.

SUMMARY OF THE INVENTION

In one form of the invention a boom is provided comprising an arcuate rail and a pivotable structure including an upright support having wheels rotatably supported upon the rail and a truss supported above the rail by the upright support. A grapple is suspended from the truss and a winch mounted to the pivotable structure for raising and lowering the grapple. Hydraulic circuit means are mounted to the pivotable structure for driving the wheels, winch and grapple. Electric circuit means are also provided for controlling the hydraulic circuit means and which include a set of solenoid valves mounted on the pivotable structure and a set of solenoid valve actuators mounted off the pivotable structure.

In another form of the invention a boom is provided comprising a circular rail, an upright support having wheels rotatably supported upon the circular rail, and a truss supported above the circular rail by the upright support. One end of the truss is pivotably mounted centrally of the circular rail while the other end overhangs the circular rail. The boom further includes an hydraulic circuit having a pump and an hydraulic motor mounted to the upright support for driving the wheels bidirectionally.

In another form of the invention a boom is provided comprising a rail, an upright support having wheels rotatably supported on the rail, a truss supported above the rail by the upright support, and a grapple suspended from the truss which includes a pair of jaws and hydraulic cylinder means for operating the jaws. Hydraulic circuit means are provided for actuating the grapple jaws including a pump and a solenoid valve for controlling the direction of flow of hyraulic fluid pumped by the pump to the hydraulic cylinder means. Electric circuit means are further provided for actuating the solenoid valve.

In yet another form of the invention a boom is provided comprising a rail, a movable structure including an upright support having wheels rotatably supported upon the rail and a truss supported above the rail by the upright support. A winch is mounted on the movable structure and a grapple suspended from the truss by a cable coupled with the winch. An hydraulic motor is provided mechanically coupled with the winch. A pump is mounted on the movable structure coupled with the hydraulic motor by hydraulic circuitry. Electric pump control means are further provided coupled with the pump by electrical circuitry.

DETAILED DESCRIPTION OF THE DRAWING

Figure 1:
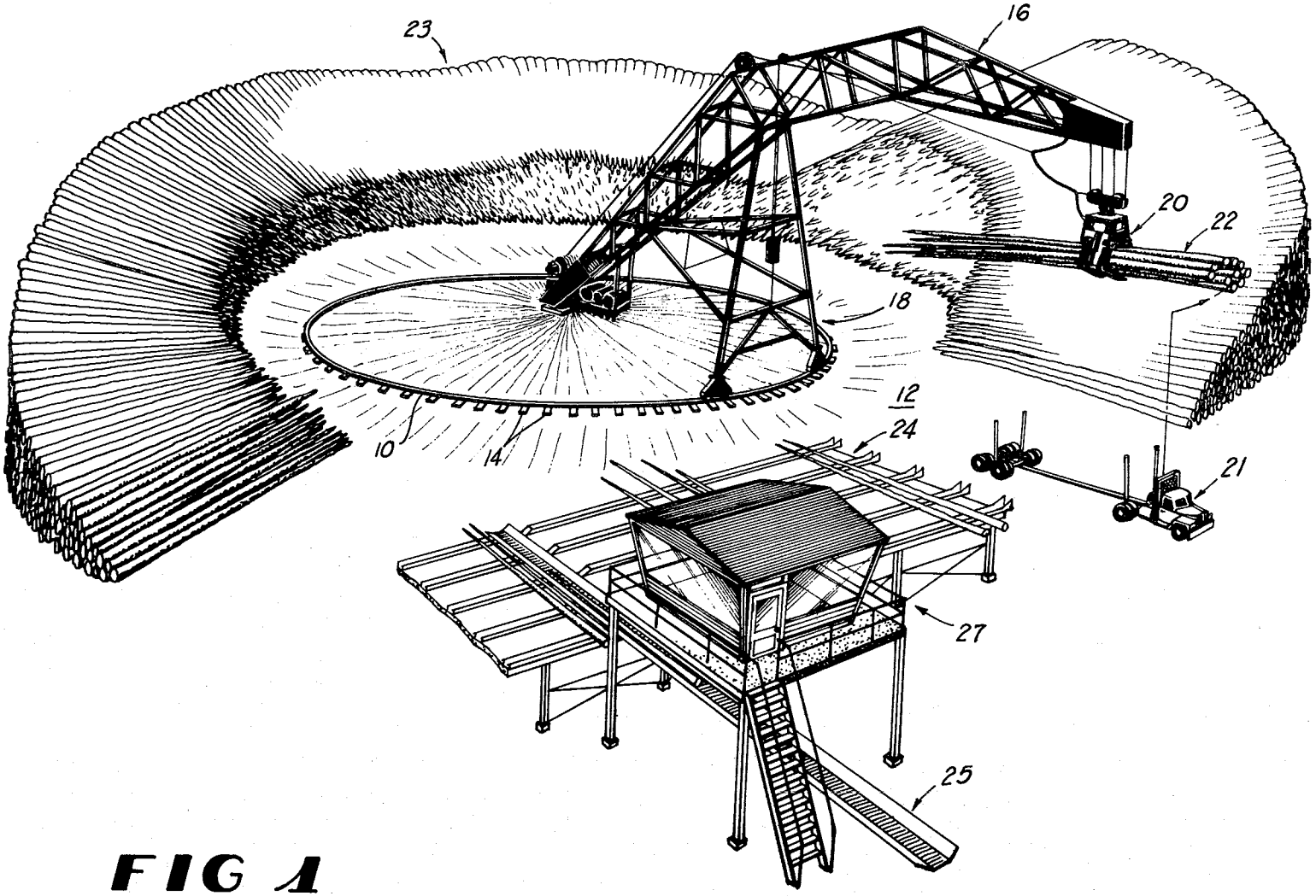
FIG. 1 is a perspective view of a boom of the type herein first described with which a control circuit embodying principles of the present invention may be employed.

Referring now in more detail to the drawing, there is shown generally in FIG. 1 a boom comprising a circular rail 10 supported on substantially level terrain 12 by a set of ties 14. An arched truss 16 of tubular and structural steel members with steel plate reinforcements at each end is supported above rail 10 by an upright A-frame support 18. A grapple 20 is suspended from an end of the truss cantilevered out beyond the bounds of the circular rail. Here, the grapple is shown positioned above a truck 21 from which it has hoisted a bundle of logs 22. From this position the boom may swing counterclockwise above rail 10 to unload the bundle of logs atop an arcuate stack of logs 23 disposed circumferentially about a portion of the rail for storage, or swing clockwise to unload the logs atop a log deck 24 for subsequent delivery to a conveyor 25 for transport to a chipping mill or the like. At other times, of course, the boom may be employed transferring logs directly between the storage area and deck. The operation of the boom is controlled from a tower 27 by electrical signals and power that is coupled to electric motors mounted upon the pivotable truss.

Figures 2, 3, 4:
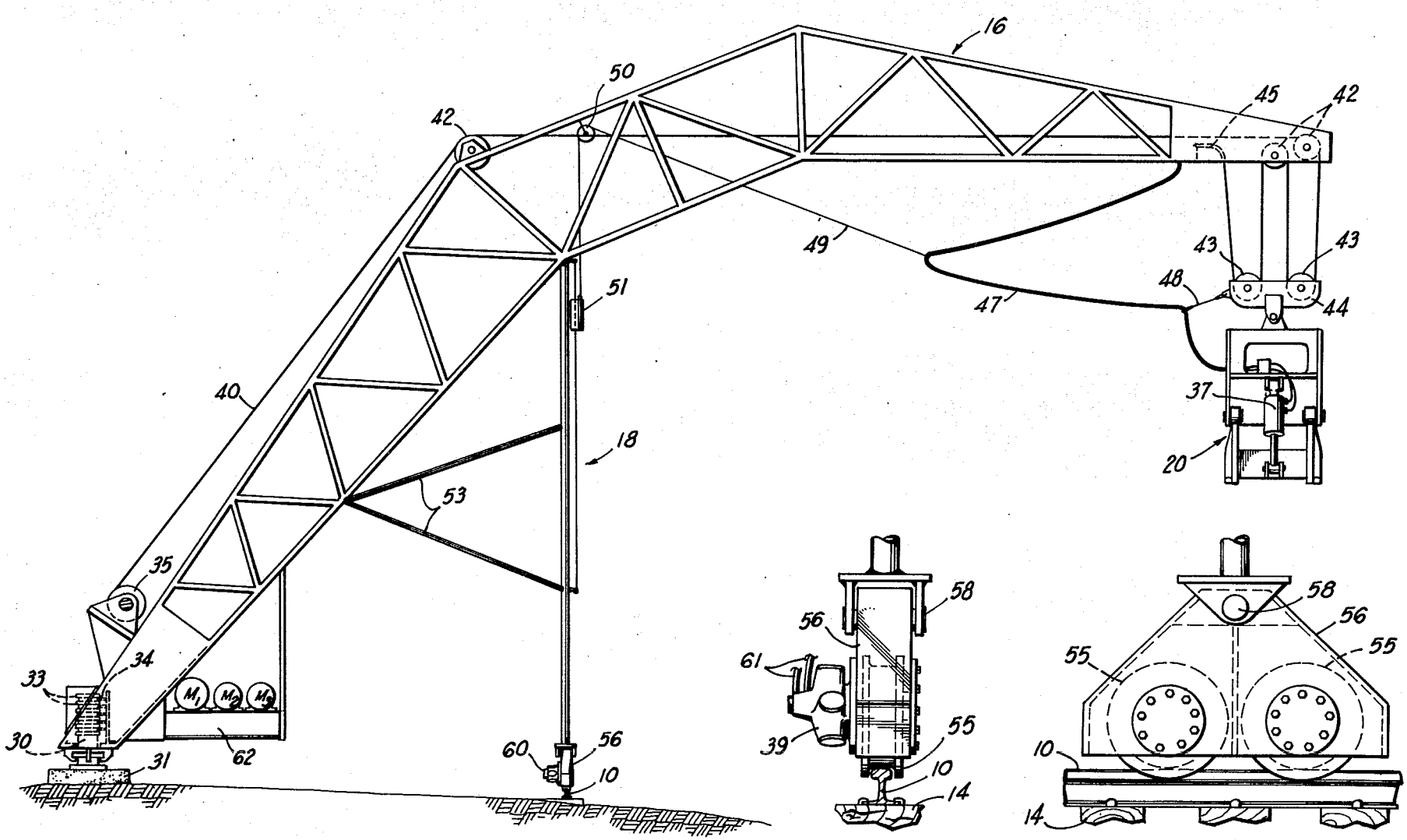
FIG. 2 is a side view in elevation of the boom shown in FIG. 1.
FIG. 3 is an enlarged side view in elevation of a component of the boom illustrated in FIG. 2.
FIG. 4 is a frontal view of the component illustrated in FIG. 3.

With reference next to FIGS. 2–4 the boom is shown in more detail to be pivotably mounted about a post 30 projecting upwardly from a concrete base 31 by conventional bearing means. A set of slip rings 33 is mounted about the post against which a set of contact brushes 34 mounted to the truss are spring biased to coupled electric power and control signals from tower 27 to motors $M_1$, $M_2$ and $M_3$, and solenoid valves supported on the truss. The motors serve, through associated hydraulic systems, to drive a winch 35 mounted to the truss for raising and lowering grapple 20, an hydraulic motor 39 mounted to the bottom of the upright A-frame support 18 to drive wheels thereon in swinging the truss over the circular rail, and a pair of cylinders 37 mounted to grapple carriage 44 for operating the grapple jaws. The winch is coupled with the grapple by means of a cable 40 which is routed from the winch over pulleys 42 mounted to truss 16 and pulleys 43 mounted to grapple carriage 44 to a terminal tie-down 45 on the truss. Hydraulic fluid for driving grapple cylinders 37 is delivered through flexible lines 47 suspended beneath truss 16. This line is held adjacent the truss by a guide wire 48 coupled with grapple carriage 44 and a guide line 49 looped over a pulley 50 weighted by a counterweight 51.

The A-frame support 18 is secured by a set of struts 53 uprightly beneath truss 16 with spaced sets of wheels 55 rotatably supported upon rail 10. Each set of wheels is journalled in a wheel housing 56 pivotably mounted beneath the support by pins 58. The wheels are driven by hydraulic motor 39 to which lines 61 communicate with a tank 62 supported on truss 16 beneath motor $M_2$ and a pump $P_2$.

Figure 5:
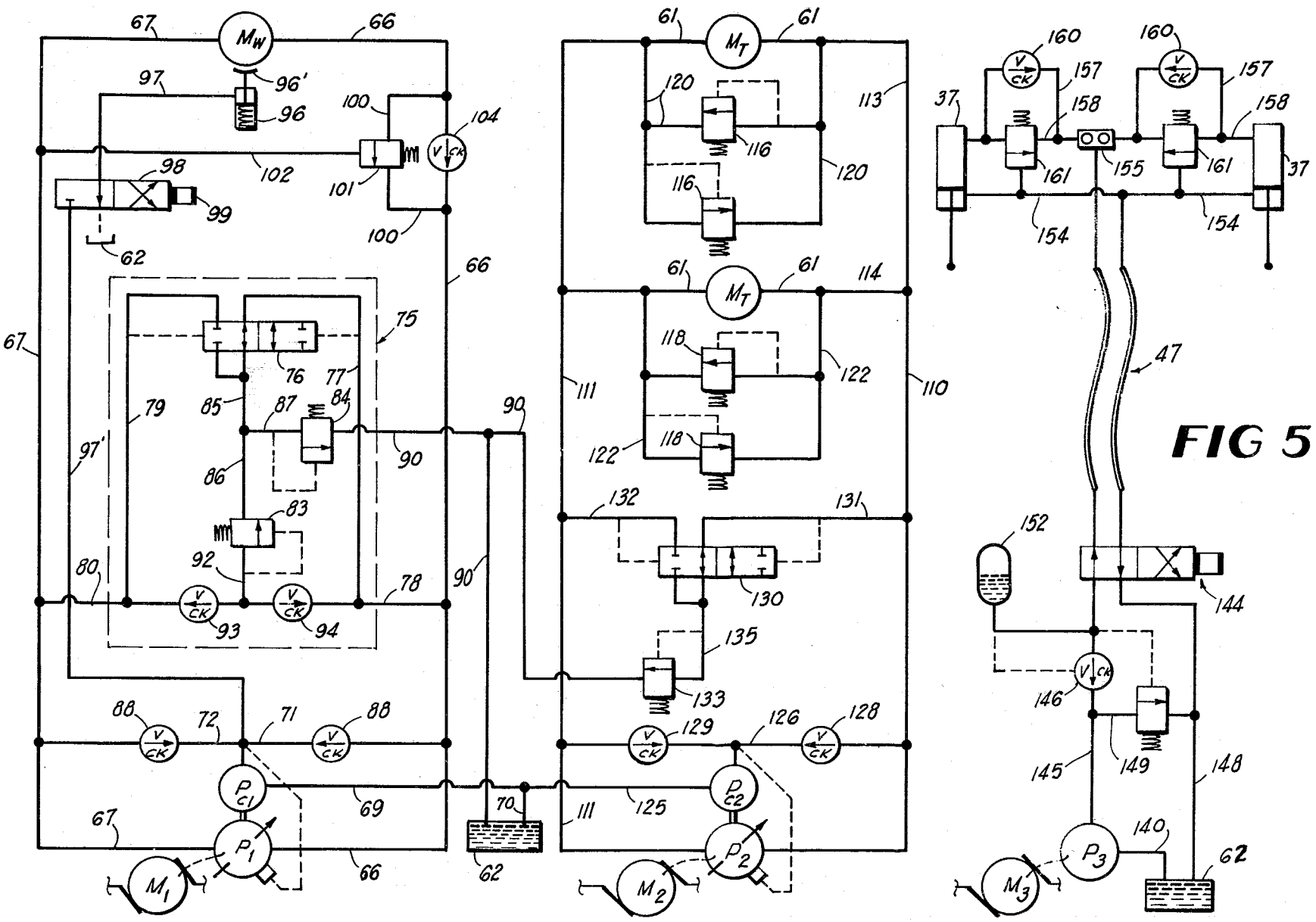
FIG. 5 is a schematic view of a hydraulic circuit employing principles of the invention in a preferred form for use in operating the boom shown in FIGS. 1–4.

With reference next to FIG. 5, the winch is seen to be driven by a hydraulic system which includes a pump $P_1$ which may be driven in opposite rotary directions by electric motor $M_1$ to force hydraulic fluid from the pump through either line 66 or 67 to winch motor $M_w$. The system is supplied with fluid by a continuously operating charging pump $P_{cl}$ which is coupled with a tank 62 by lines 69 and 70 and also with lines 66 and 67 by lines 71 and 72, respectively. Check valves 88 are incorporated in both lines 71 and 72 to prevent fluid from flowing from lines 66 and 67 to the charging pump.

The hydraulic system for operating the winch is seen further to include a transmission valve assembly 75 which includes a shuttle valve 76 coupled with line 66 by lines 77 and 78 and with line 67 by lines 79 and 80. The shuttle valve, which is operable by pressure differentials between lines 77 and 79, is here shown positioned with line 79 under higher pressure than line 77. So positioned, the other side of the shuttle valve drains into tank 62 through lines 85 and 90 through a low pressure relief valve 84 which serves to maintain normal line pressure in the system. Lines 66 and 67 are respectively connected to the shuttle valve through lines 78 and 80, check valves 94 and 93, bifurcating line 92, high pressure relief valve 83 and lines 86 and 85.

The winch motor is seen to be further provided with a brake to arrest winch movement whenever it is not being operated by motor $M_1$ and the just described hydraulic system. This brake includes a brake shoe 96[1] which is urged against the winch by a spring in brake cylinder 96 whenever the spring is not compressed by hydraulic fluid fed through lines 97 and 97[1] from charging pump $P_{c1}$ through a slide valve 98 actuable by a solenoid 99. To minimize leakage in the event of line breakage a check valve 104 is incorporated into line 66 together with a valve bypass line 100 in which a relief valve 101 is placed operatable by the pressure in line 67 to which it is coupled by line 102.

To operate the winch, motor $M_1$ is energized to drive pump $P_1$ in one rotational direction or the other by electrical circuitry hereinafter to be described, and to drive charging pump $P_{cl}$ in drawing fluid continuously into the system from tank 62. Should the pump be driven so as to pump fluid out therefrom through line 66 the fluid will flow freely through check valve 104 to drive winch motor $M_w$ in one direction and return to pump $P_1$ through line 67. Should the pump be driven conversely so as to pump fluid out therefrom through line 67 the fluid will operate the winch motor in the opposite direction and then return through line 66 to pump $P_1$ bypassing check valve 104 through line 100 and relief valve 101 which has been opened by the higher pressure of fluid in line 67 than in line 66. During this operation of the winch brake shoe 96[1] is released by actuation of solenoid 99 which positions slide valve 98 to the left coupling lines 97 and 97[1] which in turn enables fluid pumped by charging pump $P_{cl}$ to compress the spring in cylinder 96. Also during winch operations hydraulic pressure in the system is regulated by low pressure relief valve 84 which opens to drain fluid into tank 62 when it senses the pressure in line 87, and thus that also in lines 66 or 67, to exceed a preelected valve. In the event of dangerously excessive pressure, high pressure relief valve 83 operates to couple both lines 66 and 67 through check valves 94 and 93, respectively, to line 87 for drainage through the low pressure relief valve and line 90 to tank 62.

Turning next to that portion of the hydraulic system which powers wheels 55 rotatably mounted to the bottom of upright support 18 to swing truss 16 over rail 10, motor $M_2$ is seen to power a reversible, rotary pump $P_2$ to force fluid either through line 110 or 111 in driving two hydraulic motors $M_T$ connected in parallel by lines 113 and 114 and flexible lines 61 to lines 110 and 111. The two motors $M_T$ are mounted to the two wheel housings 56 at the bottom of the upright A-frame support to drive wheels 55 rotatably disposed therewithin. A pair of relief valves 116 and 118 are incorporated into bypass lines 120 and 122, respectively, about motors $M_T$. A charging pump $P_{c2}$ is provided to draw fluid continuously from tank 62 through a line 125 and then into lines 110 and 111 through line 126 which includes check valves 128 and 129 to prevent a reverse flow of fluid to the pump. A shuttle valve 130 is also provided coupling lines 131 and 132 to line 90 and tank 62 through line 135 and low pressure relief valve 133.

In operation, energization of motor $M_2$ causes pump $P_2$ to drive motor $M_T$ in either one direction or the other by forcing fluids through lines 110 and 111. Sufficiently of fluid is insured by charging pump $P_{c2}$ which draws from tank 62. Fluid pressure is continuously regulated by the low pressure relief valve 133 which operates in response to sensed pressure in line 135. This latter line is coupled with either line 131 or 132 depending on whether pump $P_2$ is momentarily pumping out through line 110 or 111 as served by shuttle valve 130. The presence of relief valves 116 and 118 in motor bypass line 120 and 122 prevents excessive build up of fluid pressure in the system by the momentum of the boom in causing wheels 55 to continue to rotate briefly after $P_2$ is deenergized due to the inertia of the movable components of the boom.

With continued reference to FIG. 5, the hydraulic system for powering the boom grapple is seen to include an electric motor $M_3$ for driving a fixed volume output pump $P_3$ in drawing fluid through line 140 from tank 62. Pump $P_3$ is connected to a pair of flexible lines 47 through a solenoid valve 144 by line 145 having a check valve 146 therein. A drain line 148 is provided between the solenoid valve and tank 62. A bypass line 149 having a relief valve 150 therein couples line 145 and drain lines 148. An accumulator 152 is provided to operate check valve 146 and relief valve 150. On the grapple an end of one flexible line 47 is connected directly to cylinders 37 by lines 154 while the other flexible line 47 is connected to the opposite ends of the cylinder through a flow divider 155 and parallel line 157 and 158. Lines 157 include check valves 160 while lines 158 include relief valves 161.

To close grapple 20 motor $M_3$ is energized to power fixed volume output pump $P_3$, and solenoid valve 144 energized to position the valve as illustrated. This action causes pump $P_3$ to pump hydraulic fluid up through line 145, check valve 146, solenoid valve 144, one flexible line 47 to flow divider 155. From here the fluid is directed through lines 157 and check valves 160 to operate cylinders 37 which drain through lines 154, 47, the solenoid valve and line 148 to tank 62. Once cylinders 37 have stroked and pressure builds, accumulator 152 closes check valve 146 and opens relief valve 150 whereupon fluid from pump $P_3$ commences to cycle through the circuit consisting of line 145, line 149, relief valve 150, line 148 and tank 62. When reversal of cylinders 37 is desired to operate the grapple solenoid valve 144 is actuated whereupon accumulator 152 senses a pressure drop and opens check valve 146 and closes relief valve 150. Line 145 is then connected by the other flexible line 47 to line 154, and the cylinders drain through lines 158, 47 and 148 to tank 62. Again, when the cylinders have stroked the accumulator valve closes check valve 146 and opens relief valve 150.

Figure 6:
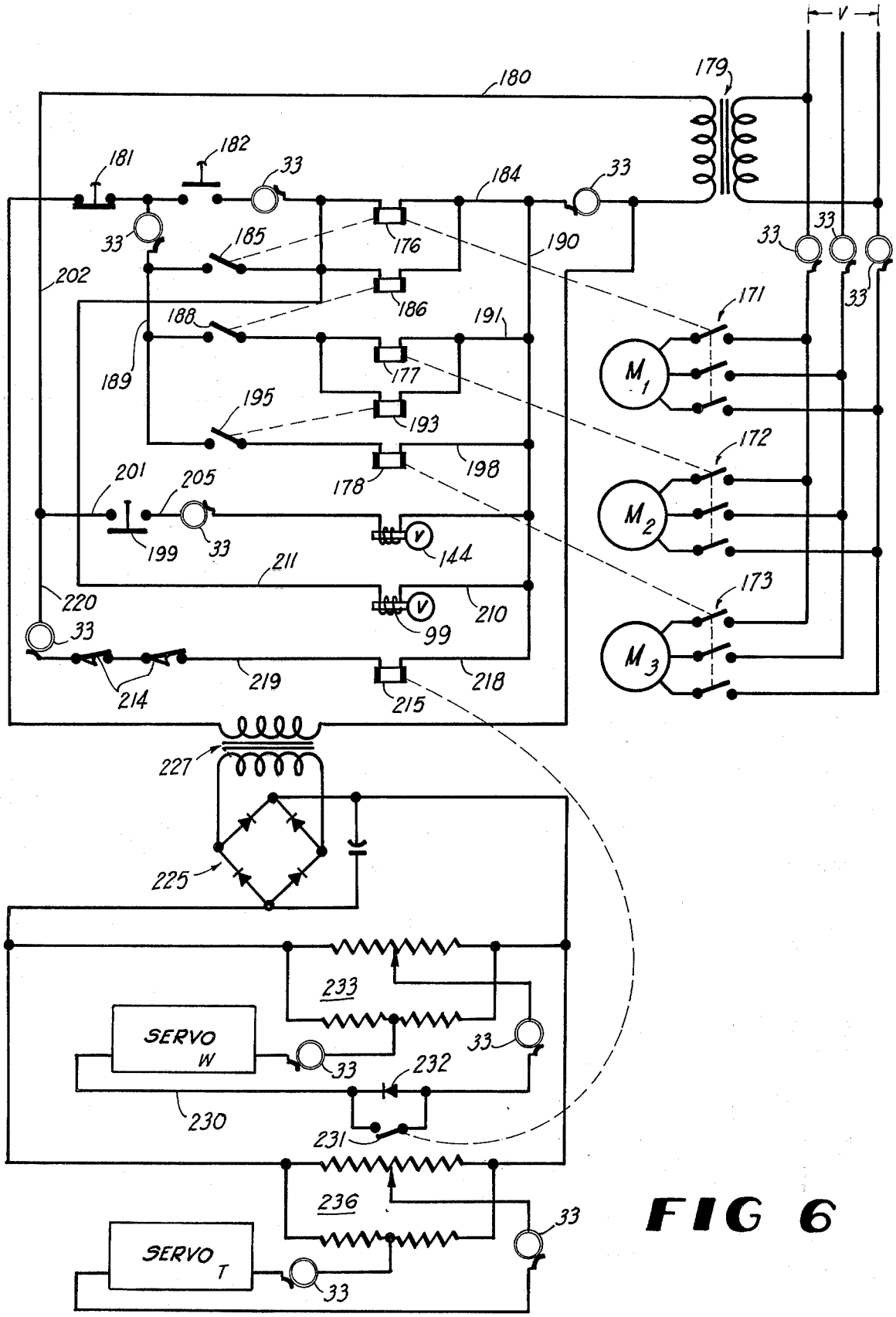
FIG. 6 is a schematic view of an electric circuit which may be used in controlling the hydraulic circuit illustrated in FIG. 5.

With reference next to FIG. 6, motors $M_1$, $M_2$ and $M_3$ are seen to be connectable through slip rings 33 across a voltage source V through switches 171, 172 and 173, respectively, which are operated by relay solenoids 176, 177 and 178, respectively. A stepdown transformer 179 is coupled across the voltage source with the secondary winding connected by a conductor 180 through serially joined stop and start switches 181 and 182, respectively, to one set of slip rings 33. This set of rings is connected across solenoid 176 by conductor 184. Another switch 185 operable by solenoid 176 is connected to conductor 184 and another slip ring through time relay 186. This solenoid operates a switch 188 connected to the other slip ring by line 189 and to conductor 184 by line 190 and 191 through another solenoid 177, having a time relay 193 connected thereacross. Time relay 193 operates a switch 195 connected to lines 189 and 190 by line 198 and solenoid 178.

Solenoid valve 144 for controlling the grapple is connected across lines 190 and 202 through yet another slip ring 33 and switch 199. The solenoid valve 99 for operating the winch brake is connected across lines 190 and 180 by lines 210 and 211 through serially joined stop and start switches 181 and 182. Solenoid 215 for operating the winch itself is connected across lines 190 and 180 by line 218, 219, 220 and 202 through slip rings and two serially connected limit switches 214.

The servo controls for operating the winch and for swinging the truss are powered by low voltage direct current taped off of voltage V through stepdown transformer 179 and a full wave rectifier 225 connected across the secondary winding of another stepdown transformer 227. Servo W, controlling pump $P_1$ of the winch, is seen to be connected by line 230 through a parallel switch 231 and diode 232 circuit and two other slip rings 33 coupled through a manually operated voltage regulator 233 across rectifier 225. Servo T, for controlling hydraulic motor 39 in swinging the truss, is also connected across rectifier 225 through a manually operated voltage regulator 236.

For operation, the start and stop switches 181 and 182 are both closed actuating relay solenoid 176 which closes switches 171 placing motor $M_1$ across line voltage V. Energization of solenoid 176 also closes switch 185 energizing time relay 186 which operates switch 188 coupling solenoid 177 across transformer 179 thereby operating switches 172 to power motor $M_2$ just after motor $M_1$ has come on the line. Similarly, the closing of switch 188 energizes time relay 193 which closes switch 195 placing solenoid 178 across the transfomer secondary winding. Energization of this solenoid then closes switches 173 bringing motor $M_3$ on the line shortly after energization of motor $M_2$. That the three motors are energized sequentially prevents excessive current from being momentarily demanded.

The closing of the stop and start switches 181 and 182 is also seen to energize solenoid valve 99 cutting off communication of line 97 with tank 62 and establishing communication between lines 97, 97[1] and charging pump $P_{cl}$. In the event of power loss the deenergization of this solenoid reestablishes fluid communication with tank 62 causing the brake cylinder to drain and the spring in cylinder 96 to urge shoe 96[1] against the winch in braking the winch as a safety measure. With switches 181 and 182 closed solenoid valve 144 may also be operated by manual switch 199. This operation serves to connect one end of grapple cylinders 37 to pump $P_3$ and the opposite ends to tank 62 through actuation of relief valves 161 thereby opening the grapple jaws. With the switch opened the cylinders are operated to close the jaws.

A solenoid 215 for operating pump $P_1$ and winch is seen to be connected across lines 190 and 180 by means of lines 218, 219, 220 and 202 through a slip ring 33 and a pair of serially connected limit switches 214. Should the winch raise grapple 20 too high one or both of these switches are mechanically actuated thereby deenergizing solenoid 215 which opens switch 231. With this switch open Servo W can only be operating unidirectionally in lowering the grapple due to the presence of diode 232 connected across the switch. At other times when switch 231 is closed Servo W may serve either to raise or lower the grapple by operating pump $P_1$ in either direction and at variable speeds through manual operation of voltage regulator 233 in series circuit with the servo and with switch 231 and diode 232. Servo T may similarly operate pump $P_2$ in either direction through manual operation of voltage regulator 236. Limit switches are not employed with this servo circuit due to the fact that rail 10 is of endless, circular configuration. Nor is a safety device employed for power loss contingency although either or both could be employed as in the grapple and winch control systems.

It should be realized that the just described embodiment merely illustrates principles of the invention embodied in one preferred form. Many modifications, additions and deletions may, of course, be made thereto without departure from the spirit and scope of the invention as set forth in the following claims.

What is claimed is:

1. A boom comprising an arcuate rail; a pivotable structure including an upright support having wheels rotatably supported upon said rail and a truss supported above said rail by said upright support; a grapple suspended from said truss; winch means mounted to said pivotable structure for raising and lowering said grapple; hydraulic circuit means mounted to said pivotable structure for driving said wheels, winch and grapple; electric circuit means for controlling said hydraulic circuit means including a set of solenoid valves mounted on said pivotable structure and a set of solenoid valves actuators mounted off said pivotable structure; and wherein said hydraulic circuit means for driving said winch includes a variable output hydraulic pump, an hydraulic motor mechanically coupled with said winch, and an hydraulic line coupling said hydraulic pump with said hydraulic motor.

2. A boom in accordance with claim 1 wherein said rail is circular.

3. A boom in accordance with claim 1 wherein said upright support is of A-frame construction.

4. A boom in accordance with claim 1 wherein said hydraulic circuit means for driving said winch includes transmission valve means responsive to the direction of flow of hydraulic fluid from said variable output hydraulic pump.

5. A boom in accordance with claim 1 including brake means for braking said winch coupled with said hydraulic circuit means.

6. A boom in accordance with claim 1 wherein said hydraulic circuit means for driving said wheels includes relief valve means for limiting hydraulic pressure caused by coasting of said wheels under momentum of said pivotable structure.

7. A boom in accordance with claim 1 wherein said hydraulic circuit means includes transmission valve means responsive to the direction of flow of hydraulic fluid from said pump.

* * * * *